US007518565B1

(12) United States Patent
Horner et al.

(10) Patent No.: US 7,518,565 B1
(45) Date of Patent: Apr. 14, 2009

(54) TAPERED SLOT ANTENNA CYLINDRICAL ARRAY

(75) Inventors: Rob Horner, San Diego, CA (US); Rod Cozad, San Diego, CA (US); Bruce Calder, San Diego, CA (US); Hale Simonds, Santee, CA (US); Robbi Mangra, San Diego, CA (US); Rolf Dahle, La Mesa, CA (US); Dennis Bermeo, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 288 days.

(21) Appl. No.: 11/472,514

(22) Filed: Jun. 15, 2006

(51) Int. Cl.
*H01Q 13/10* (2006.01)

(52) U.S. Cl. ..... 343/770; 343/767; 343/768

(58) Field of Classification Search ..... 343/770, 343/767, 768
See application file for complete search history.

(56) References Cited

U.S. PATENT DOCUMENTS 5,874,915 A * 2/1999 Lee et al. ..... 342/375

* cited by examiner

*Primary Examiner*—Trinh V Dinh
*Assistant Examiner*—Dieu Hien T Duong
(74) *Attorney, Agent, or Firm*—Kyle Eppele; Arthur K. Samora; Allan Y. Lee

(57) ABSTRACT

A Tapered Slot Antenna Cylindrical Array (NC#97194). The apparatus includes a base and a tapered slot antenna array. The base is capable of retaining a plurality of tapered slot antenna pairs. The tapered slot antenna array is operatively coupled to the base in a cylindrical configuration. The tapered slot antenna array comprises at least two tapered slot antenna pairs. Each tapered slot antenna pair of the at least two tapered slot antenna pairs is capable of operating independently of or in conjunction with other tapered slot antenna pairs of the at least two tapered slot antenna pairs to enable direction finding, acquisition, communication and electronic attack capabilities.

13 Claims, 11 Drawing Sheets

Top View

Side View

Top View

302

Top View

304

Top View

NOTE: All figures are NOT drawn to scale.

306

Top View

308

Top View

NOTE: All figures are NOT drawn to scale.

400

Top View

Side View

TAPERED SLOT ANTENNA CYLINDRICAL ARRAY

FEDERALLY SPONSORED RESEARCH AND DEVELOPMENT

This invention (Navy Case No. 97194) is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case Number 97194.

CROSS-REFERENCE TO RELATED APPLICATIONS

This application is related to U.S. Pat. No. 7,009,572, issued on Mar. 7, 2006, entitled "Tapered Slot Antenna", by Rob Horner et al., Navy Case No. 96507, which is hereby incorporated by reference in its entirety herein for its teachings on antennas. This application is also related to U.S. Ser. No. 10/932,646 filed on Aug. 31, 2004, entitled "Concave Tapered Slot Antenna" by Rob Horner et al., Navy Case No. 96109, which is hereby incorporated by reference in its entirety herein for its teachings on antennas.

BACKGROUND OF THE INVENTION

The present invention is generally in the field of antennas.

Typical antenna arrays require at least one separate antenna or antenna set for each of the following capabilities: direction finding (DF), acquisition (ACQ), communication (COM) and information operations (IOP). Thus, typical antenna arrays that have multiple capabilities are large, bulky and expensive. In addition, typical antenna arrays lack ultra broad band frequency capabilities and lack high gain/directivity.

A need exists for a small, inexpensive antenna array having DF, ACQ, COM and IOP capabilities, as well as, ultra broad band frequency capabilities and high gain/directivity.

BRIEF DESCRIPTION OF THE DRAWINGS

All FIGURES are not drawn to scale.

DETAILED DESCRIPTION OF THE INVENTION

The present invention is directed to Tapered Slot Antenna Cylindrical Arrays.

DEFINITIONS

The following acronyms and definition(s) are used herein:

Acronym(s):

ACQ—Acquisition

COM—Communication

DF—Direction Finding

I/O—Input/Output

IOP—Information Operations

RF—Radio Frequency

TSA—Tapered Slot Antenna

TSACA—Tapered Slot Antenna Cylindrical Array

Tx/Rx—Transmitter/Receiver

Definition(s):

Information Operations—Radio Frequency Jamming and/or Electronic Attack

The tapered slot antenna cylindrical array (TSACA) includes a base and a tapered slot antenna (TSA) array operatively coupled to the base. The TSACA includes at least two tapered slot antenna pairs. In one embodiment, at least one angle formed between adjacent tapered slot antenna pairs with respect to a transverse plane is different than the remaining angles formed between adjacent tapered slot antenna pairs with respect to a transverse plane. In one embodiment, each tapered slot antenna pair forms approximately equal angles with respect to adjacent tapered slot antenna pairs with respect to a transverse plane. In addition, each TSA pair is capable of operating independently of or in conjunction with other TSA pairs of the TSACA. Thus, the TSACA is capable of DF, ACQ, COM and IOP. In one embodiment, the TSACA includes two TSA pairs. In one embodiment, the TSACA includes three TSA pairs. In one embodiment, the TSACA includes four TSA pairs. In one embodiment, the TSACA includes five TSA pairs. In one embodiment, the TSACA includes six TSA pairs. In one embodiment, the TSACA includes eight TSA pairs. In one embodiment, the TSACA includes sixteen TSA pairs. In one embodiment, the TSACA includes thirty-two TSA pairs. In one embodiment, the TSACA includes a radome to enclose the TSA pairs. In one embodiment, the base comprises a single cylindrical element. In one embodiment, the base comprises two hemi-cylindrical elements. In one embodiment, the TSACA is operatively coupled to a mast of a ship via the base of the TSACA. In one embodiment, the TSACA is operatively coupled to a pole mounted on a building, antenna tower, bridge or other tall structure via the base of the TSACA.

Figure 1A:
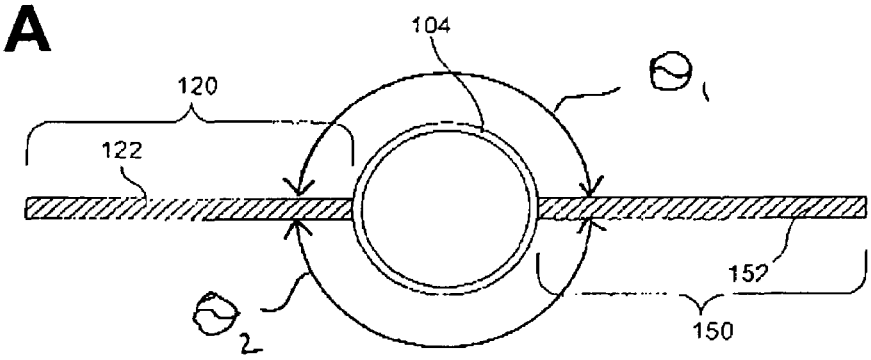
FIG. 1A is a top and side view of one embodiment of a TSACA.

FIG. 1A is a top and side view of one embodiment of a tapered slot antenna cylindrical array. As shown in FIG. 1A, TSACA 102 includes base element 104, TSA pair 120 and TSA pair 150. Base element 104 comprises a material capable of supporting TSA pairs 120, 150. In one embodiment, base element 104 comprises a substantially nonconductive material such as, for example, plastic and G10, wherein TSA pairs 120, 150 directly connect to base element 104. In one embodiment, base element 104 comprises a substantially conductive material such as, for example, aluminum and steel, wherein TSA pairs 120, 150 are operatively coupled to base element 104 using a substantially non-conductive brace (see brace 740 of FIG. 7A). Base element 104 has a cylindrical configuration. Base element 104 is adapted to be operatively coupled to a cylindrical structure such as a ship mast or a pole mounted to a tall structure. Base element 104 is adapted to retain TSA pairs 120, 150.

Figure 1A:
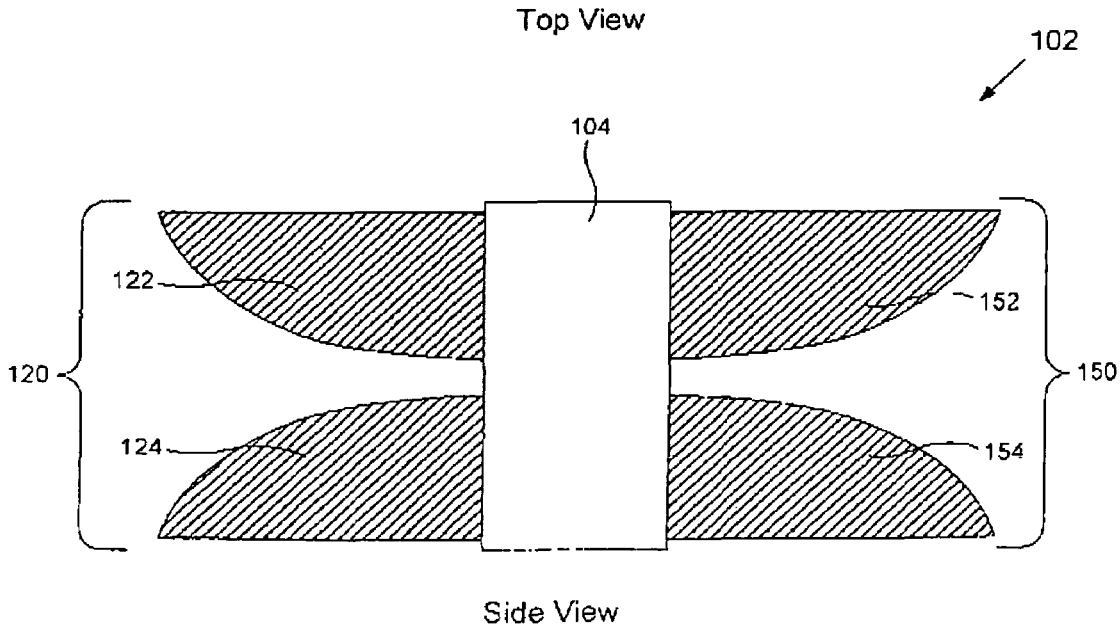

TSA pairs 120, 150 form a TSA array having a cylindrical configuration. TSA pairs 120, 150 are operatively coupled to base element 104. As shown in the top view of FIG. 1A, TSACA 102 is configured so that angles $\theta_1$ and $\theta_2$ formed between adjacent TSA pairs (i.e., TSA pairs 120, 150) with respect to a transverse plane form approximately equal angles. Thus, approximately 180 degree angles ($\theta_1$ and $\theta_2$) are formed between adjacent TSA pairs of TSACA 102 with respect to a transverse plane. It should be appreciated, however, that TSACA 102 is can be configured so that angles formed between adjacent TSA pairs with respect to a transverse plane form unequal angles. For example, TSA pair 120 and TSA pair 150 shown at FIG. 1 could be arranged so that $\theta_1$=140 degrees and $\theta_2$ equals 220 degrees. Each TSA pair (i.e., TSA pair 120, TSA pair 150) includes two TSA elements situated in a TSA configuration. As shown in FIG. 1A, TSA pair 120 includes TSA element 122 and TSA element 124; and TSA pair 150 includes TSA element 152 and TSA element 154. TSA elements 122, 124, 152, 154 comprise a substantially conductive material such as, for example, stainless steel and aluminum. TSA elements 122, 124, 152, 154 are capable of transmitting and receiving radio frequency (RF) energy.

TSA elements 122, 124, 152, 154 have feed ends (ends closer to base element 104) and launch ends (ends farther from base element 104). The feed ends can be operatively coupled to an input/output (I/O) feed such as a coaxial cable. The I/O feed can be used to transmit and receive RF signals to and from TSACA 102. RF signals can be transmitted from the feed end toward the launch end, wherein the RF signals launch from an antenna pair at a point between the feed end and the launch end depending upon the signal frequency. RF signals having higher frequencies launch closer to the feed end and RF signals having lower frequencies launch closer to the launch end. TSA pairs 120, 150 are capable of operating independently of or in conjunction with each other. Thus, TSACA 102 is capable of DF, ACQ, COM and IOP.

Figure 1B:
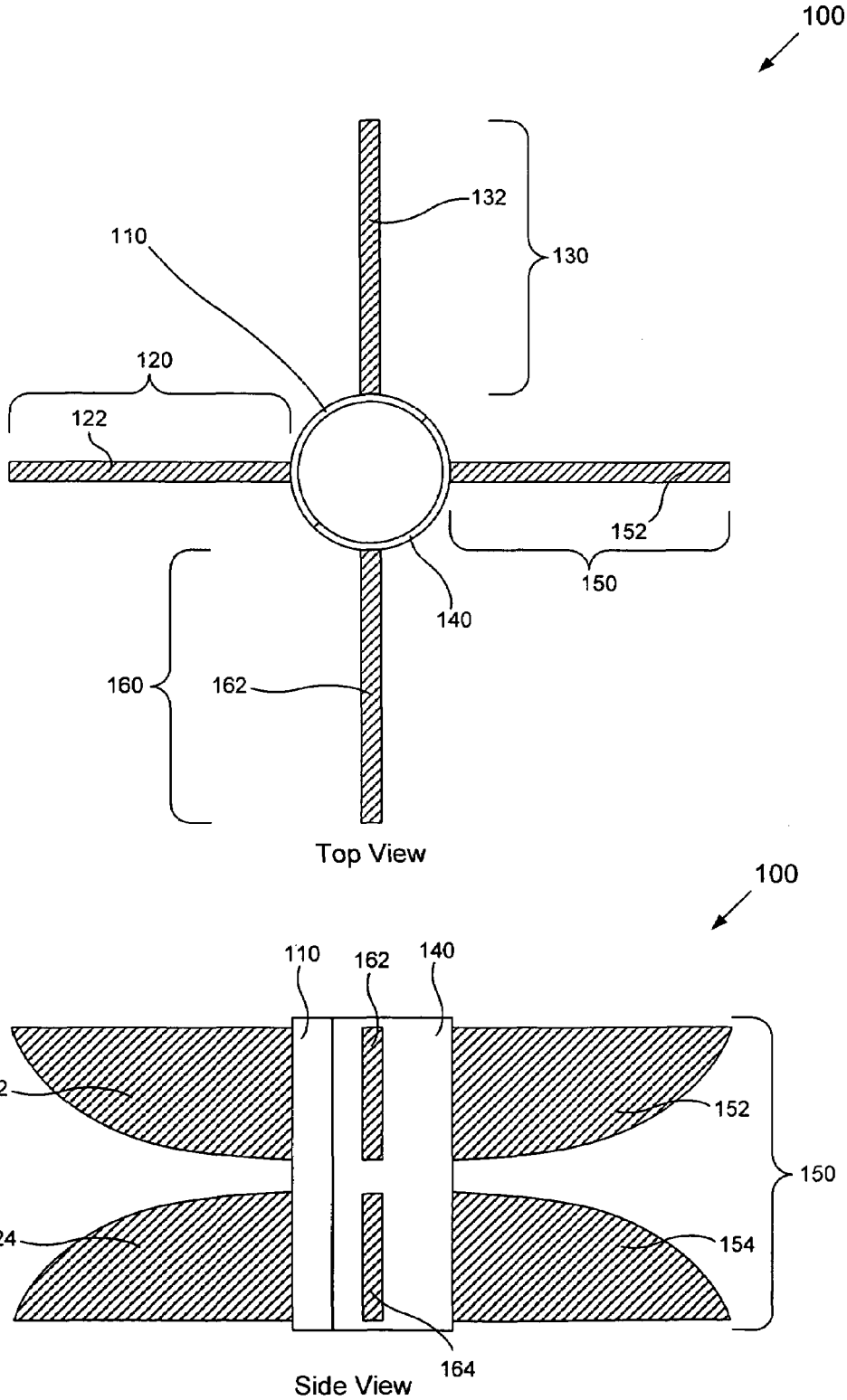
FIG. 1B is a top and side view of one embodiment of a TSACA.

FIG. 1B is a top and side view of one embodiment of a tapered slot antenna cylindrical array. As shown in FIG. 1B, TSACA 100 includes first base element 110, second base element 140, TSA pair 120, TSA pair 130, TSA pair 150 and TSA pair 160. First base element 110 and second base element 140 comprise a substantially nonconductive material such as, for example, plastic and G10. First base element 110 and second base element 140 each have a hemi-cylindrical (i.e., half-pipe) configuration. First base element 110 is operatively coupled to second base element 140 to form a cylinder having a cylindrical cavity. First base element 110 and second base element 140 are adapted to be operatively coupled to a cylindrical structure such as a ship mast. First and second base elements 110, 140 are adapted to retain TSA pairs 120, 130, 150, 160.

TSA pairs 120, 130, 150, 160 form a TSA array having a cylindrical configuration. TSA pairs 120, 130 are operatively coupled to first base element 110. TSA pairs 150, 160 are operatively coupled to second base element 140. As shown in the top view of FIG. 11B, TSACA 100 is configured so that angles formed between adjacent TSA pairs (e.g., TSA pairs 120, 130, 150, 160) form approximately equal angles with respect to a transverse plane. Thus, approximately 90 degree angles are formed between adjacent TSA pairs of TSACA 100 with respect to a transverse plane. Each TSA pair (i.e., TSA pair 120, TSA pair 130, TSA pair 150 and TSA pair 160) includes two TSA elements situated in a TSA configuration. As shown in FIG. 1B, TSA pair 120 includes TSA element 122 and TSA element 124; TSA pair 130 includes TSA element 132 and another TSA element (not shown in FIG. 1B); TSA pair 150 includes TSA element 152 and TSA element 154; and TSA pair 160 includes TSA element 162 and TSA element 164. TSA elements 122, 124, 132, 152, 154, 162, 164 comprise a substantially conductive material such as, for example, stainless steel and aluminum. TSA elements 122, 124, 132, 152, 154, 162, 164 are capable of transmitting and receiving radio frequency (RF) energy.

TSA elements 122, 124, 132, 152, 154, 162, 164 have feed ends (ends closer to first and second base elements 110, 140) and launch ends (ends farther from first and second base elements 110, 140). The feed ends can be operatively coupled to an input/output (I/O) feed such as a coaxial cable. The I/O feed can be used to transmit and receive RF signals to and from TSACA 100. RF signals can be transmitted from the feed end toward the launch end, wherein the RF signals launch from an antenna pair at a point between the feed end and the launch end depending upon the signal frequency. RF signals having higher frequencies launch closer to the feed end and RF signals having lower frequencies launch closer to the launch end. TSA pairs 120, 130, 150, 160 are capable of operating independently of or in conjunction with each other. Thus, TSACA 100 is capable of DF, ACQ, COM and IOP.

In one embodiment, TSA elements 122, 124 have curvatures that can each be represented by the following Equation 1:

$$Y(x)=a(e^{bx}-1); \quad \text{(Equation 1)}$$

where, a and b are parameters selected to produce a desired curvature. In one embodiment, parameters "a" and "b" are approximately equal to 0.2801 and 0.1028, respectively, and x is the length of the element and Y is the width of the element.

Figure 2:
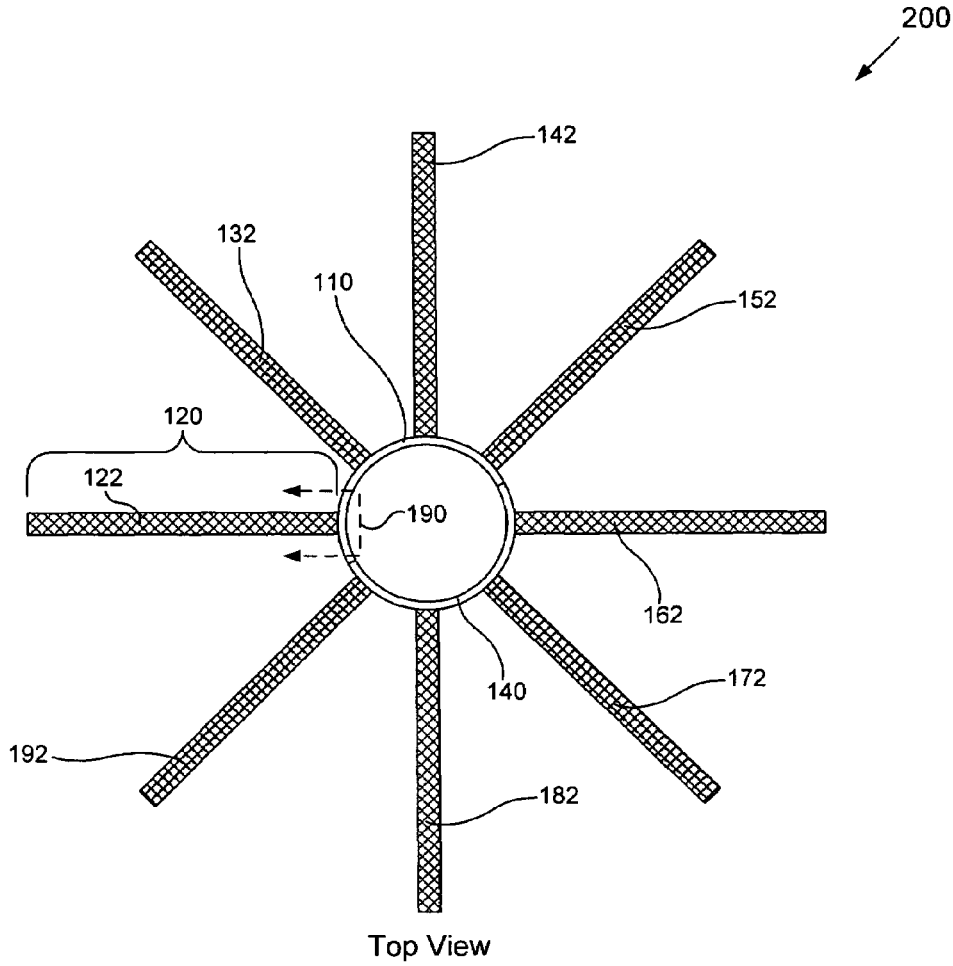
FIG. 2 is a top and partial side view of one embodiment of a TSACA.
Figure 2:
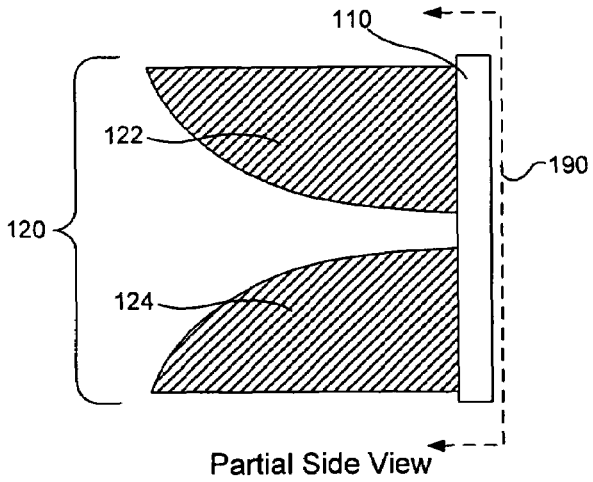

FIG. 2 is a top and partial side view of one embodiment of a tapered slot antenna cylindrical array. TSACA 200 of FIG. 2 is substantially similar to TSACA 100 of FIG. 1B, and thus, similar components are not described again in detail hereinbelow. As shown in FIG. 2, TSACA 200 includes first base element 110, second base element 140 and eight TSA pairs corresponding to TSA elements 122, 132, 142, 152, 162, 172, 182, 192 (e.g., TSA pair 120 corresponds to TSA element 122).

TSA pairs corresponding to TSA elements 122, 132, 142, 152, 162, 172, 182, 192 form a TSA array having a cylindrical configuration. TSA pairs corresponding to TSA elements 122, 132, 142, 152 are operatively coupled to first base element 110. TSA pairs corresponding to TSA elements 162, 172, 182, 192 are operatively coupled to second base element 140. As shown in the top view of FIG. 2, TSACA 200 is configured so that angles formed between adjacent TSA pairs form approximately equal angles with respect to a transverse plane. Thus, approximately 45 degree angles are formed between adjacent TSA pairs of TSACA 200 with respect to a transverse plane. Each TSA pair includes two TSA elements situated in a TSA configuration. As shown in FIG. 2 with regard to the partial side view along line 190, TSA pair 120 includes TSA element 122 and TSA element 124. TSA pairs corresponding to TSA elements 122, 132, 142, 152, 162, 172, 182, 192 comprise a substantially conductive material such as, for example, stainless steel and aluminum and are capable of transmitting and receiving RF energy. TSA pairs corresponding to TSA elements 122, 132, 142, 152, 162, 172, 182, 192 are capable of operating independently of or in conjunction with each other. Thus, TSACA 200 is capable of DF, ACQ, COM and IOP.

Figure 3A:
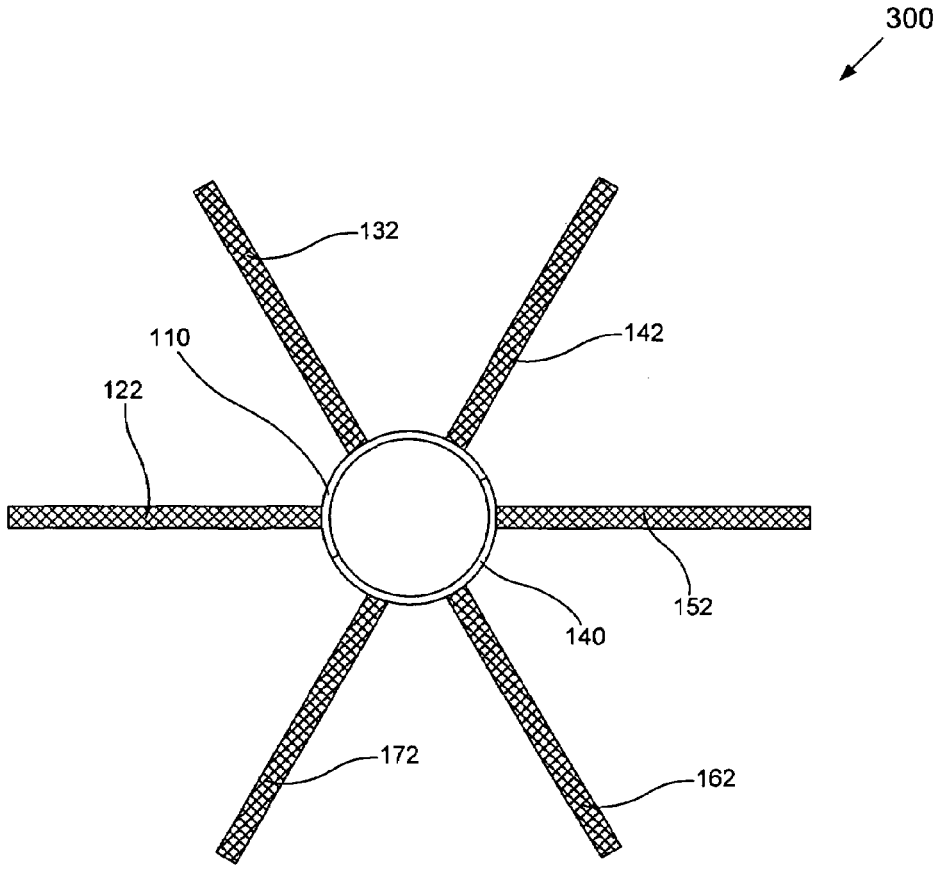
FIG. 3A is a top view of one embodiment of a TSACA.

FIG. 3A is a top view of one embodiment of a tapered slot antenna cylindrical array. TSACA 300 of FIG. 3A is substantially similar to TSACA 100, 102 of FIGS. 1A and 1B, and thus, similar components are not described again in detail hereinbelow. As shown in FIG. 3A, TSACA 300 includes first base element 10, second base element 140 and six TSA pairs corresponding to TSA elements 122, 132, 142, 152, 162, 172.

TSA pairs corresponding to TSA elements 122, 132, 142, 152, 162, 172 form a TSA array having a cylindrical configuration. TSA pairs corresponding to TSA elements 122, 132, 142 are operatively coupled to first base element 110. TSA pairs corresponding to TSA elements 152, 162, 172 are operatively coupled to second base element 140. As shown in FIG. 3A, TSACA 300 is configured so that angles formed between adjacent TSA pairs form approximately equal angles with respect to a transverse plane. Thus, approximately 60 degree angles are formed between adjacent TSA pairs of TSACA 300 with respect to a transverse plane. Each TSA pair includes two TSA elements situated in a TSA configuration. TSA pairs corresponding to TSA elements 122, 132, 142, 152, 162, 172 comprise a substantially conductive material such as, for example, stainless steel and aluminum and are capable of transmitting and receiving RF energy. TSA pairs corresponding to TSA elements 122, 132, 142, 152, 162, 172 are capable of operating independently of or in conjunction with each other. Thus, TSACA 300 is capable of DF, ACQ, COM and IOP.

Figure 3B:
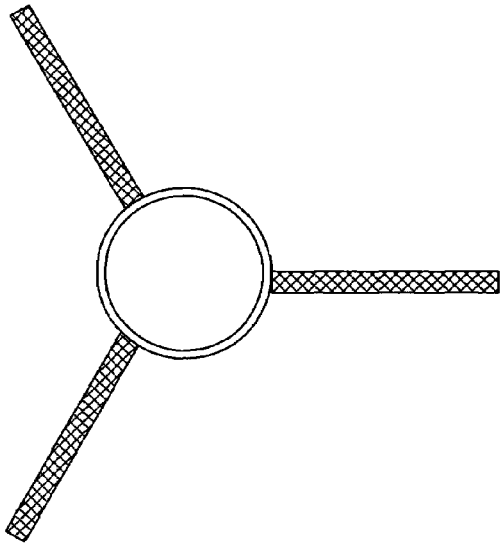
FIG. 3B is a top view of several embodiments of a TSACA.
Figure 3B:
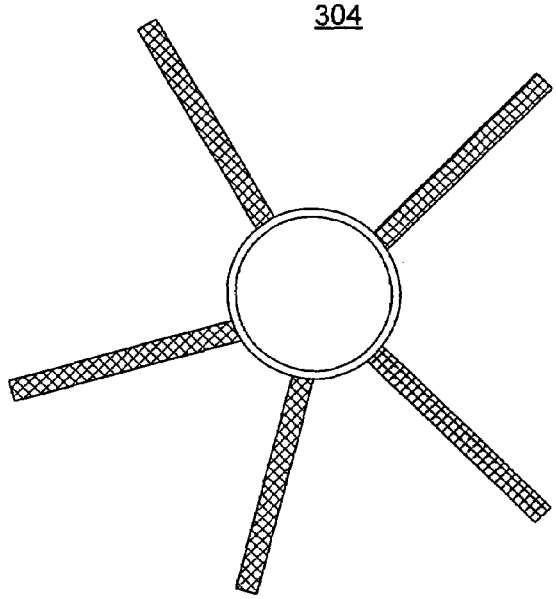
Figure 3B:
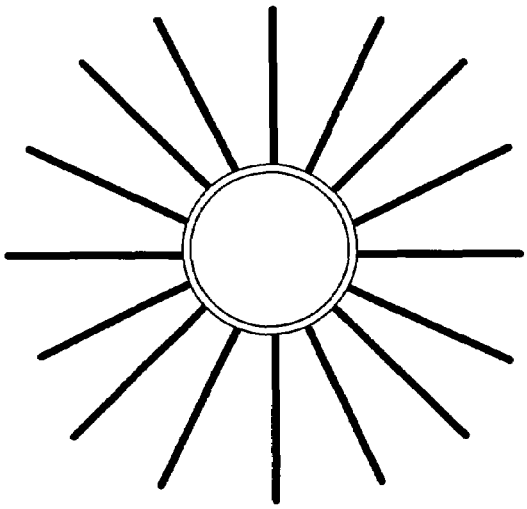
Figure 3B:
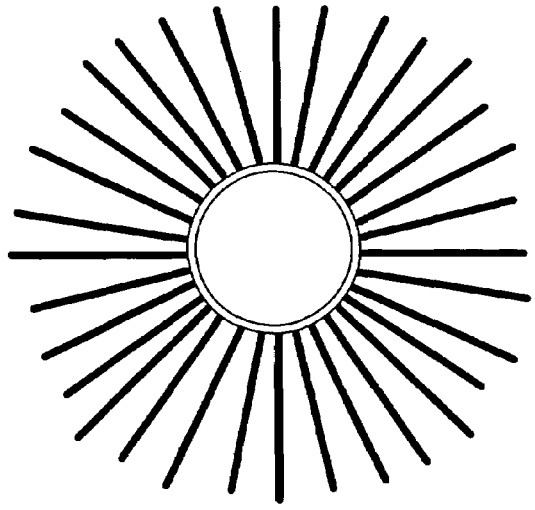

FIG. 3B is a top view of several embodiments of a tapered slot antenna cylindrical array. All figures of FIG. 3B are not drawn to scale. TSACA 302, 304, 306, 308 of FIG. 3B are substantially similar to TSACA 100, 102 of FIGS. 1A and 1B, and thus, similar components are not described again in detail hereinbelow. As shown in FIG. 3B, TSACA 302 includes a base element having a cylindrical configuration and three TSA pairs operatively coupled to the base element. TSACA 302 is configured so that angles formed between adjacent TSA pairs with respect to a transverse plane form at least one unequal angle relative to the other angles.

As shown in FIG. 3B, TSACA 304 includes a base element having a cylindrical configuration and five TSA pairs operatively coupled to the base element. TSACA 304 is configured so that angles formed between adjacent TSA pairs with respect to a transverse plane form at least one unequal angle relative to the other angles.

As shown in FIG. 3B, TSACA 306 includes a base element having a cylindrical configuration and sixteen TSA pairs operatively coupled to the base element. TSACA 306 is configured so that angles formed between adjacent TSA pairs with respect to a transverse plane form at least one unequal angle relative to the other angles.

As shown in FIG. 3B, TSACA 308 includes a base element having a cylindrical configuration and thirty-two TSA pairs operatively coupled to the base element. TSACA 308 is configured so that angles formed between adjacent TSA pairs with respect to a transverse plane form at least one unequal angle relative to the other angles.

Figure 4:
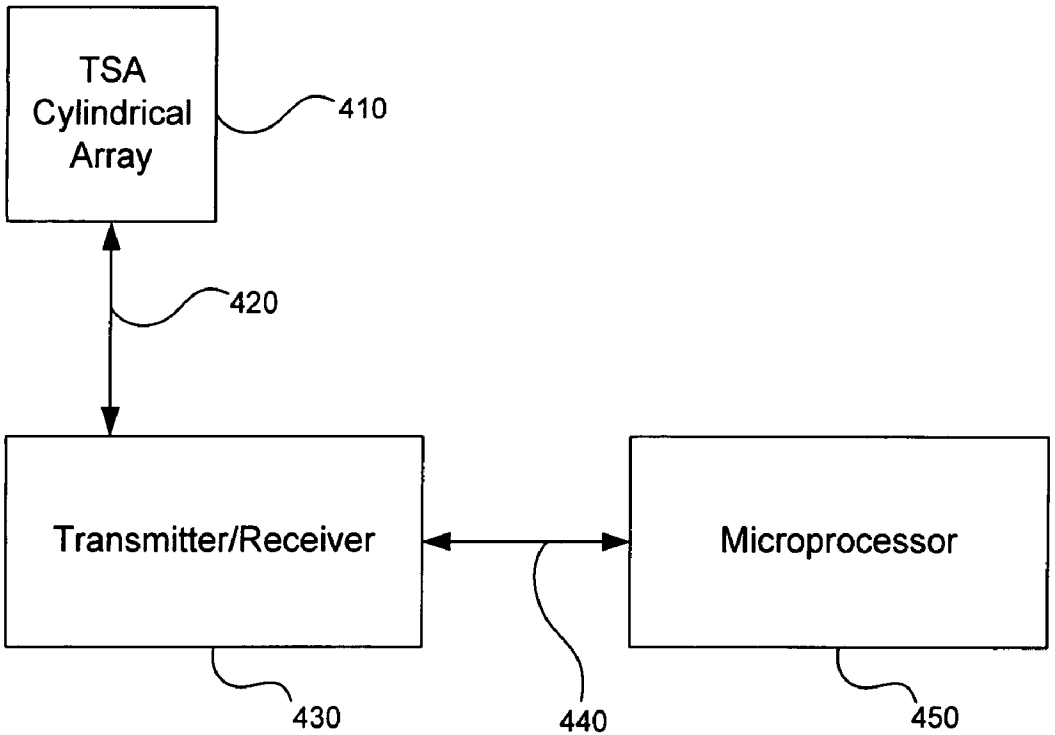
FIG. 4 is a block diagram of one embodiment of a TSACA system.

FIG. 4 is a block diagram of one embodiment of a TSACA system. As shown in FIG. 4, TSACA system 400 includes TSACA 410, RF link 420, Transmitter/Receiver (Tx/Rx) 430, communication link 440 and microprocessor 450. TSACA 410 is capable of DF, ACQ, COM and IOP. Exemplary embodiments of TSACA 410 include TSACA 100, 200, 300 of FIGS. 1, 2, 3, respectively. TSACA 410 is operatively coupled to Tx/Rx 430 via RF link 420. RF link 420 is capable of providing RF signals to and from TSACA 410 and Tx/Rx 430. In one embodiment, RF link 420 comprises a plurality of coaxial cables, wherein each TSA pair of TSACA 410 is operatively coupled to a separate coaxial cable. RF link 420 is also capable of providing electronics control signals for one or more electronics devices operatively coupled to TSACA 410. For example, RF link 420 is capable of providing electronics control signals for commutators (i.e., switch matrices), RF amplifiers, limiters and filters that are operatively coupled to TSACA 410.

Tx/Rx 430 of FIG. 4 is capable of generating, transmitting and receiving RF signals. Tx/Rx 430 is capable of receiving multiple RF signals from TSACA 410. Tx/Rx 430 is capable of contemporaneously receiving RF signals from two or more TSA pairs of TSACA 410. Tx/Rx 430 is capable of generating and transmitting multiple RF signals to TSACA 410. Tx/Rx 430 is capable of contemporaneously transmitting RF signals to two or more TSA pairs of TSACA 410 in response to microprocessor 450. Tx/Rx 430 is operatively coupled to microprocessor 450 via communication link 440. Microprocessor 450 is capable of receiving RF signals from Tx/Rx 430. Microprocessor 450 is capable of controlling the output of Tx/Rx 430 so that multiple RF signals can be transmitted to two or more TSA pairs of TSACA 410.

Figure 5:
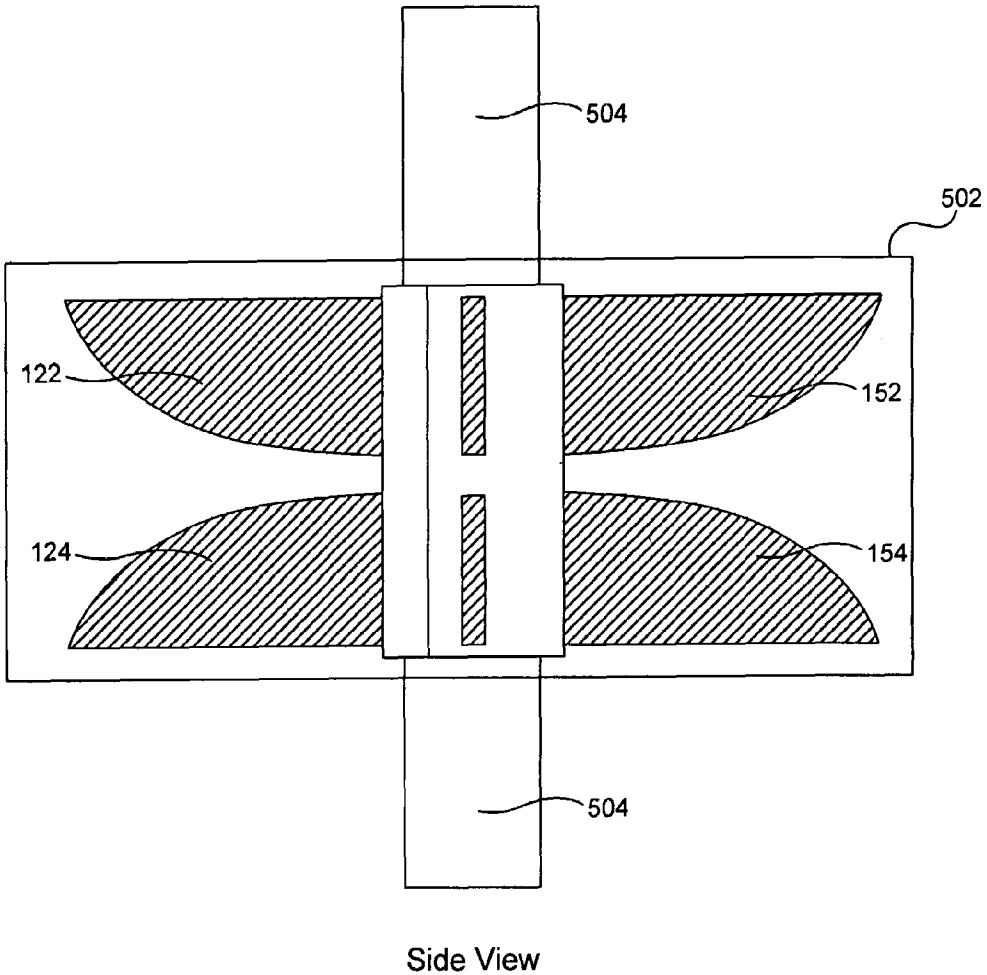
FIG. 5 is a side view of one embodiment of a TSACA system.

FIG. 5 is a side view of one embodiment of a TSACA system. The TSACA system of FIG. 5 includes a TSACA operatively coupled to a structure and encased in a radome. As shown in FIG. 5, TSACA system 500 includes a TSACA operatively coupled to structure 504 and encased by radome 502. The TSACA includes four TSA pairs. One TSA pair comprises TSA elements 122, 124. Another TSA pair comprises TSA elements 152, 154. In one embodiment, structure 504 comprises a mast of a ship. In one embodiment, structure 504 comprises a pole fixed to a stationary object such as a building. Radome 502 comprises dielectric material capable of substantially encapsulating the TSACA of FIG. 5. In one embodiment, radome 502 is capable of substantially sealing the TSACA from an external environment. In one embodiment, radome 502 is electrically transparent to all RF energy. In one embodiment, radome 502 is electrically transparent to a band of RF energy. In one embodiment, radome 502 comprises frequency selective surface material. In one embodiment, radome 502 comprises durable material. In one embodiment, radome 502 comprises fiberglass cloth with polyester resin.

Figure 6:
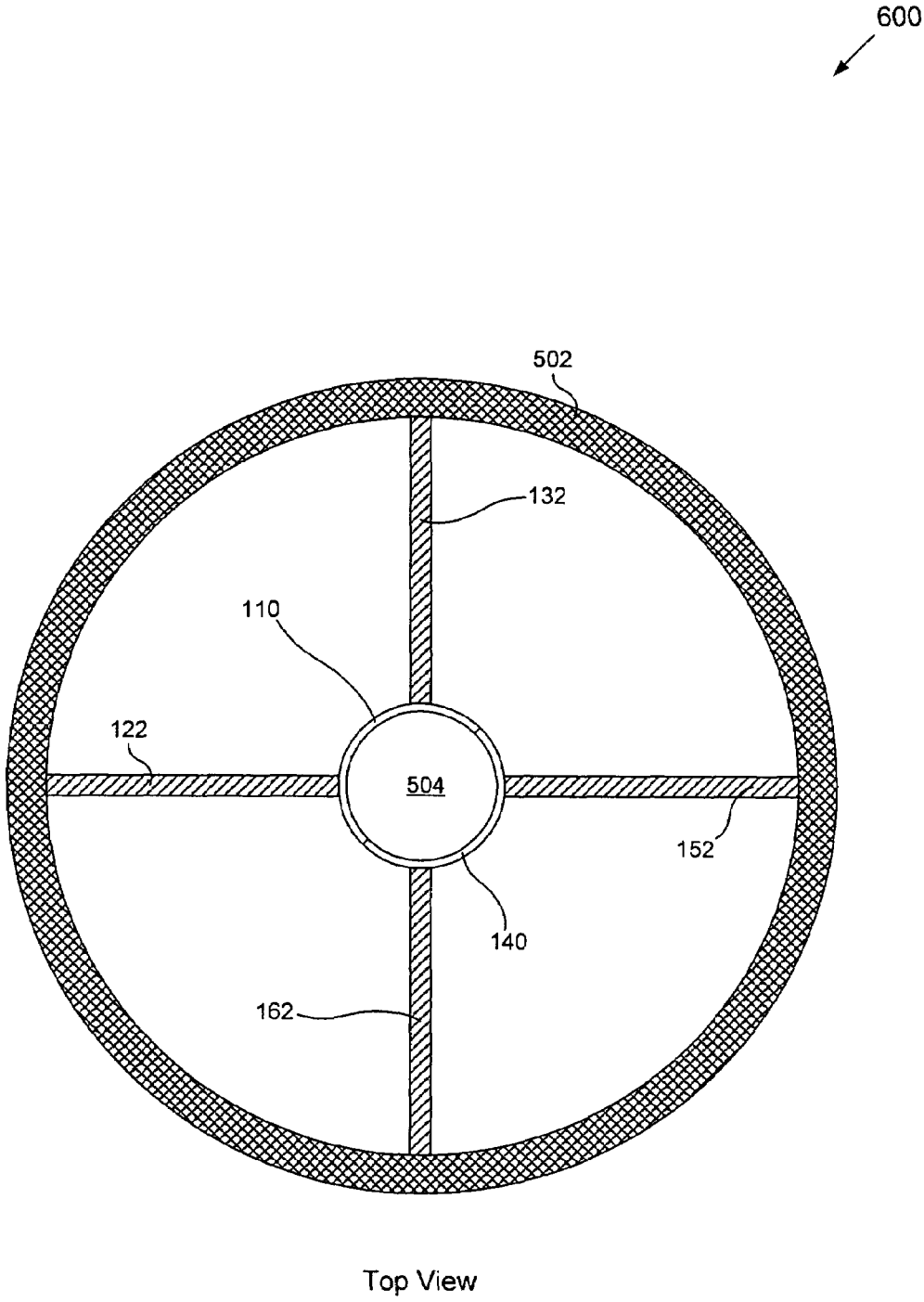
FIG. 6 is a top view of one embodiment of a TSACA system.

FIG. 6 is a top view of one embodiment of a TSACA system of FIG. 5. As shown in FIG. 6, TSA pairs corresponding to TSA elements 122, 132, 152, 162 are enclosed by radome 502. The TSACA of FIG. 6 is operatively coupled to structure 504. In one embodiment, the TSACA of FIG. 6 is operatively coupled by attaching first base element 110 and second base element 140 around structure 504 in a cylindrical fashion.

Figure 7A:
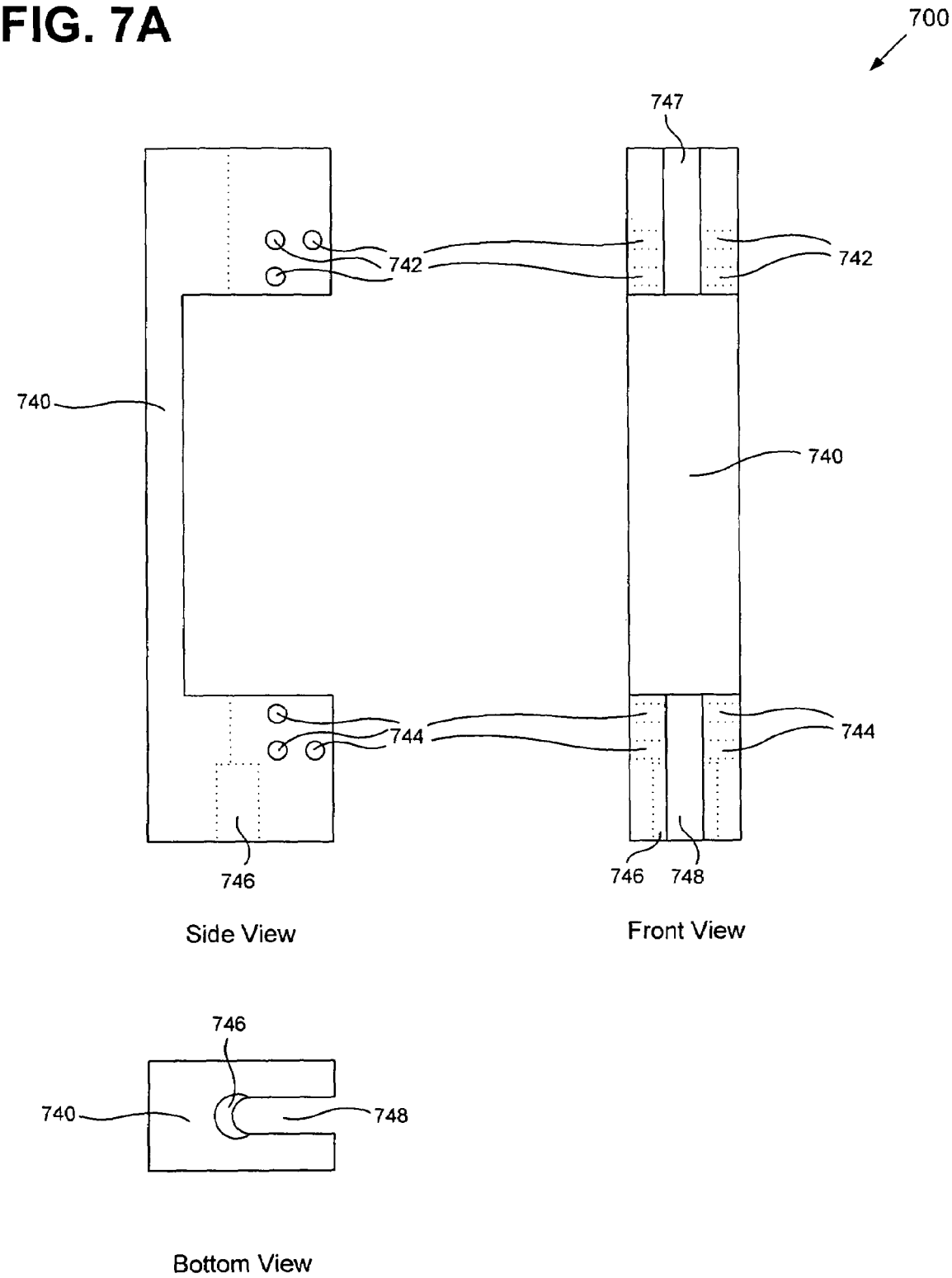
FIG. 7A is a side and top view of some of the features of an exemplary TSA formed in accordance with one embodiment of a TSACA.
Figure 7B:
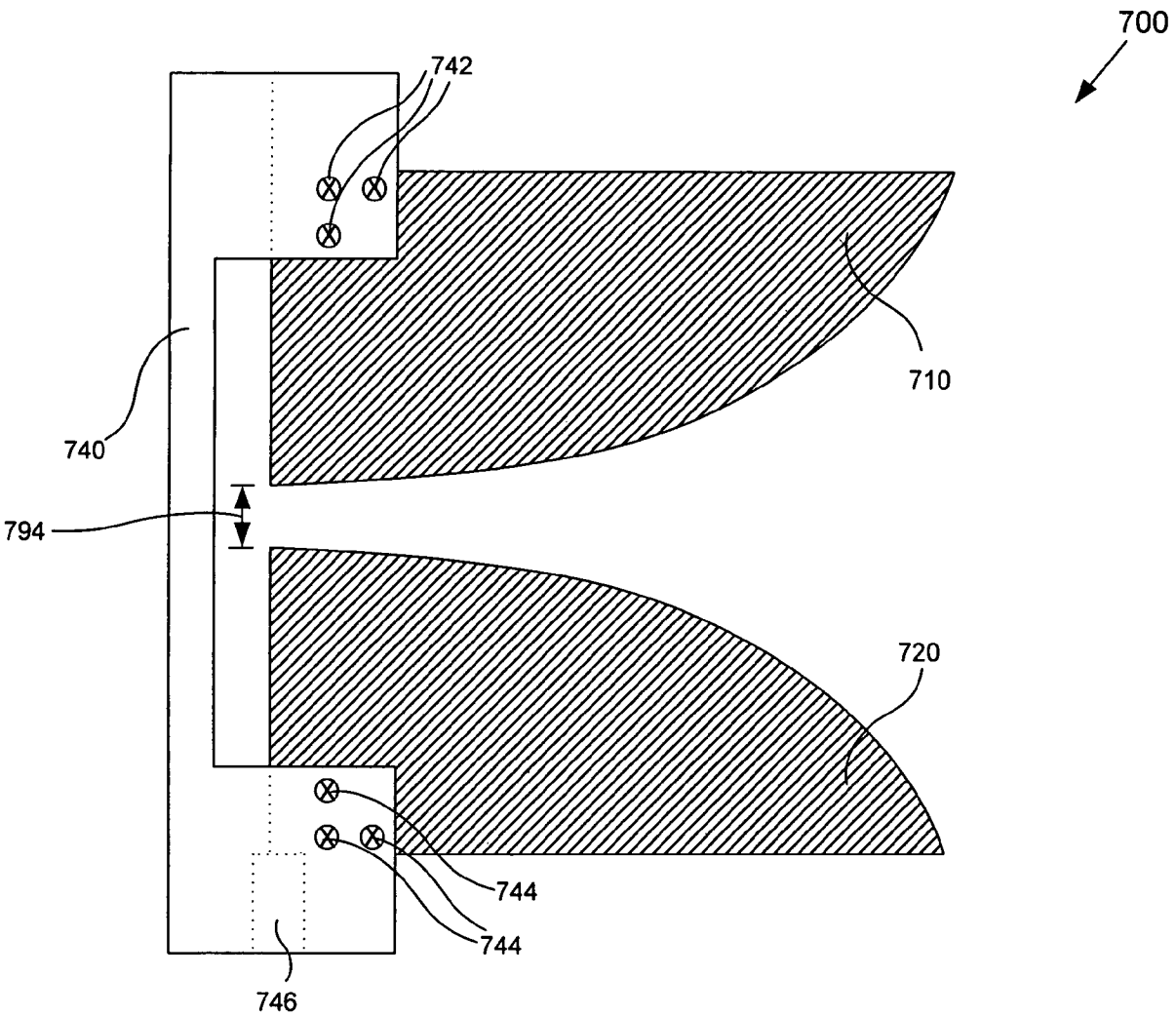
FIG. 7B is a side view of some of the features of an exemplary TSA formed in accordance with one embodiment of a TSACA.

FIGS. 7A-7B show some of the features of an exemplary TSA formed in accordance with one embodiment of a TSACA. FIG. 7A is a side, front and bottom view of some of the features of an exemplary TSA 700 formed in accordance with one embodiment of a TSACA. FIG. 7A is a side, front and bottom view of one embodiment of brace 740. Brace 740 comprises a substantially nonconductive material such as, for example, plastic and G10. As shown in FIG. 7A, brace 740 includes slots 747, 748, apertures 742, 744 and receiver aperture 746. Slots 747, 748 are adapted to snugly receive TSA elements in a tapered slot antenna configuration. Apertures 742, 744 are adapted to substantially align with apertures formed within TSA elements so that a fastener such as a threaded screw can operatively couple TSA elements to brace 740. Apertures 742, 744 are adapted to decrease the width of slots 747, 748 when used in conjunction with fasteners such as nuts and bolts, and thus, TSA elements can be securely coupled to brace 740 using slots 747, 748. In one embodiment, apertures 742, 744 are threaded apertures. Receiver aperture 746 is adapted to receive an I/O feed such as an outer jacket of a coaxial cable.

FIG. 7B is a side view of some of the features of an exemplary TSA formed in accordance with one embodiment of a TSACA. As shown in FIG. 7B, first TSA element 710 is operatively coupled to brace 740 via fasteners (represented on FIG. 7B by the symbol "X") used in conjunction with apertures 742. Similarly, second TSA element 720 is operatively coupled to brace 740 via fasteners (represented on FIG. 7B by the symbol "X") used in conjunction with apertures 744. The TSA pair (i.e., first TSA element 710 and second TSA element 720) of TSA 700 has gap height 794. Brace 740 is capable of being operatively coupled to base elements 110, 140 of FIGS. 1, 2, 3 and 6.

Figure 8:
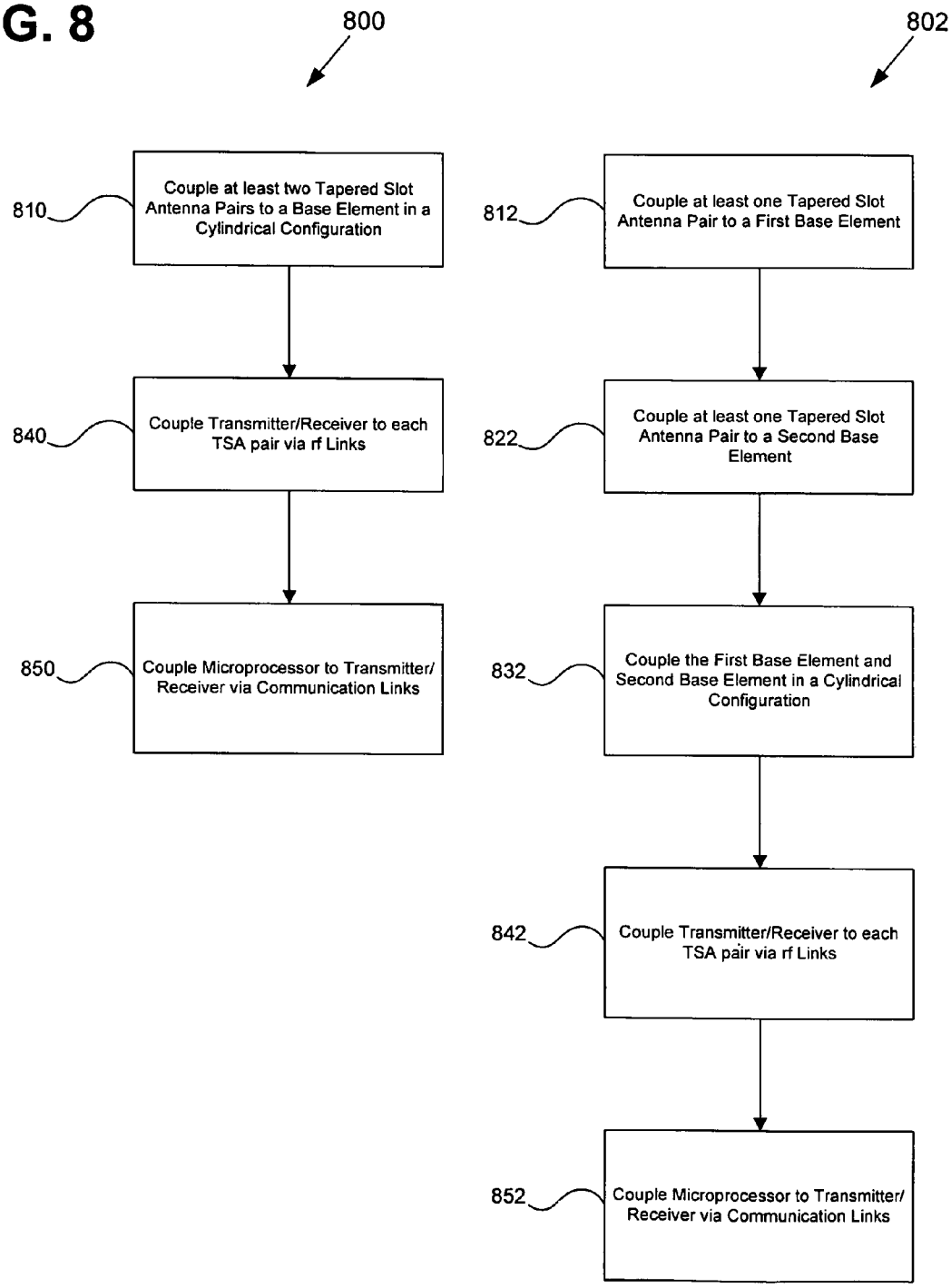
FIG. 8 is a flowchart of an exemplary method of manufacturing one embodiment of a TSACA.

FIG. 8 includes flowcharts illustrating exemplary processes to implement an exemplary TSACA. While flowcharts 800, 802 are sufficient to describe one embodiment of an exemplary TSACA, other embodiments of the TSACA may utilize procedures different from those shown in flowcharts 800, 802.

We claim:

1. An apparatus, comprising:

a cylindrical base;

a plurality of tapered slot antennas arranged in pairs;

each of said tapered slot antenna pairs further including two antennas having curvatures represented by the equation $Y(x)=a(e^{bx}-1)$, wherein, a and b are parameters selected to produce a desired curvature, x is the length of the antenna and Y is the width of the antenna;

each of said tapered slot antenna pairs operatively coupled to said cylindrical base, comprising at least two tapered slot antenna pairs, wherein each tapered slot antenna pair of said at least two tapered slot antenna pairs is selectively operated independently of said other tapered slot antenna pair of said at least two tapered slot antenna pairs to enable direction finding, acquisition, communication and information operations capabilities; and, each said tapered slot antenna pair including two antenna elements, each said antenna element having a feed end and a launch end, said feed end contacting said base so that said antenna element extends radially outward from said cylindrical base.

2. The apparatus of claim 1, wherein said apparatus is configured so that angles that are formed between adjacent tapered slot antenna pairs, when said apparatus is viewed from a top plan view, are equal.

3. The apparatus of claim 1, wherein said apparatus is configured so that angles that are formed between adjacent tapered slot antenna pairs, when said apparatus is viewed from a top plan view, are not equal.

4. The apparatus of claim 1, wherein a number of tapered slot antenna pairs is selected from the group consisting of two, three, four, five, six, eight, sixteen and thirty-two.

5. The apparatus of claim 1, wherein said at least two tapered slot antenna pairs each comprise two tapered slot antenna elements, wherein said tapered slot antenna elements comprise a substantially conductive material.

6. The apparatus of claim 1, further comprising:

a Transmitter/Receiver, capable of generating, transmitting and receiving radio frequency signals, operatively coupled to said tapered slot antenna pairs via a radio frequency link.

7. The apparatus of claim 1, wherein said Transmitter/Receiver contemporaneously receives radio frequency signals from two or more tapered slot antenna pairs of said at least two tapered slot antenna pairs.

8. The apparatus of claim 1, wherein said Transmitter/Receiver contemporaneously transmits radio frequency signals to two or more tapered slot antenna pairs of said at least two tapered slot antenna pairs.

9. The apparatus of claim 1, further comprising:

a microprocessor, for receiving radio frequency signals from said Transmitter/Receiver and controlling an output of said Transmitter/Receiver, operatively coupled to said Transmitter/Receiver via a communications link.

10. The apparatus of claim 1, wherein said Transmitter/Receiver contemporaneously transmits radio frequency signals to two or more tapered slot antenna pairs of said at least two tapered slot antenna pairs in response to said microprocessor.

11. The apparatus of claim 1, further comprising:

a radome, operatively coupled to said tapered slot antenna array, for substantially sealing said tapered slot antenna array from an external environment.

12. An apparatus, comprising:

a cylindrical base capable of retaining a plurality of tapered slot antenna pairs;

a plurality of tapered slot antennas arranged in pairs;

each of said tapered slot antenna pairs further including two antennas having curvatures represented by the equation $Y(x)=a(e^{bx}-1)$, wherein, a and b are parameters selected to produce a desired curvature, x is the length of the antenna and Y is the width of the antenna;

each of said tapered slot antenna pairs operatively coupled to said cylindrical base, comprising at least two tapered slot antenna pairs, wherein each tapered slot antenna pair of said at least two tapered slot antenna pairs is selectively operated independently of said other tapered slot antenna pair of said at least two tapered slot antenna pairs to enable direction finding, acquisition, communication and electronic attack capabilities;

wherein said tapered slot antenna pairs each include two antenna elements, each said antenna element having a feed end and a launch end, said feed end contacting said base so that said antenna element extends radially outward from said cylindrical base;

a Transmitter/Receiver, capable of generating, transmitting and receiving radio frequency signals, operatively coupled to said tapered slot antenna array via a radio frequency link; and, a microprocessor, capable of receiving radio frequency signals from said Transmitter/Receiver and controlling an output of said Transmitter/Receiver, operatively coupled to said Transmitter/Receiver via a communication link.

13. An apparatus, comprising:

a cylindrical base capable of retaining a plurality of tapered slot antenna pairs;

a plurality of tapered slot antennas arranged in pairs, each of said tapered slot antenna pairs further including two antennas having curvatures represented by the equation $Y(x)=a(e^{bx}-1)$, wherein, a and b are parameters selected to produce a desired curvature, x is the length of the antenna and Y is the width of the antenna;

a tapered slot antenna array, operatively coupled to said cylindrical base, comprising at least two tapered slot antenna pairs, wherein each tapered slot antenna pair of said at least two tapered slot antenna pairs is selectively operated independently of said other tapered slot antenna pairs of said at least two tapered slot antenna pairs to enable direction finding, acquisition, communication and electronic attack capabilities, each said tapered slot antenna pair including two antenna elements, each said antenna element having a feed end and a launch end, said feed end contacting said base so that said antenna element extends radially outward from said cylindrical base;

a radome, operatively coupled to said tapered slot antenna array, for substantially sealing said tapered slot antenna array from an external environment;

a Transmitter/Receiver, for generating, transmitting and receiving radio frequency signals, operatively coupled to said tapered slot antenna array via a radio frequency link; and, a microprocessor, for receiving radio frequency signals from said Transmitter/Receiver and controlling an output of said Transmitter/Receiver, operatively coupled to said Transmitter/Receiver via a communication link.

* * * * *